United States Patent [19]

Sweeny

[11] 4,404,757

[45] Sep. 20, 1983

[54] HEEL FILLER AND ASSEMBLY FOR BOOTS

[75] Inventor: Henry D. Sweeny, Kitchener, Canada

[73] Assignee: Swenco Limited, Waterloo, Canada

[21] Appl. No.: 263,256

[22] Filed: May 13, 1981

[30] Foreign Application Priority Data

Apr. 8, 1981 [CA] Canada ..... 374968

[51] Int. Cl.[3] ..... A43B 23/22; A43B 23/00

[52] U.S. Cl. ..... 36/107; 36/108; 36/34 R; 36/76 C

[58] Field of Search ..... 36/91, 92, 107, 108, 36/75 R, 72 A, 72 B, 69, 76 R, 76 C, 76 HH, 22 A, 24.5, 34 R, 34 A, 30 A

[56] References Cited

U.S. PATENT DOCUMENTS

| | | | |
|---|---|---|---|
| 1,863,690 | 6/1932 | Hadaway | 36/76 R |
| 1,934,092 | 11/1933 | Rigante | 36/76 R |
| 2,176,684 | 10/1939 | Quirk | 36/76 R |
| 2,198,938 | 4/1940 | Giessler . | |
| 2,202,941 | 6/1940 | Bastable | 36/34 R |
| 2,407,524 | 9/1946 | Wisecarver . | |
| 3,017,706 | 1/1962 | Maunoury . | |
| 3,453,754 | 7/1969 | Ronci . | |
| 3,835,557 | 9/1974 | Sussman . | |

FOREIGN PATENT DOCUMENTS

| | | | |
|---|---|---|---|
| 724355 | 12/1965 | Canada . | |
| 724356 | 12/1965 | Canada . | |
| 808364 | 3/1969 | Canada . | |
| 808365 | 3/1969 | Canada . | |
| 907849 | 9/1972 | Canada . | |
| 1806939 | 12/1959 | Fed. Rep. of Germany . | |
| 1899350 | 12/1963 | Fed. Rep. of Germany . | |
| 1978144 | 9/1967 | Fed. Rep. of Germany . | |
| 628338 | 10/1927 | France | 36/34 R |
| 899430 | 6/1962 | United Kingdom . | |
| 969411 | 9/1964 | United Kingdom . | |
| 991425 | 5/1965 | United Kingdom . | |
| 1003951 | 9/1965 | United Kingdom . | |
| 1030576 | 5/1966 | United Kingdom . | |
| 1130729 | 10/1966 | United Kingdom . | |
| 1049481 | 11/1966 | United Kingdom . | |
| 1075212 | 7/1967 | United Kingdom . | |
| 1322187 | 7/1973 | United Kingdom | 36/34 R |

*Primary Examiner*—Werner H. Schroeder
*Assistant Examiner*—Steven N. Myers
*Attorney, Agent, or Firm*—Colton & Stone, Inc.

[57] ABSTRACT

Improvements in protective footwear, including work boots or shoes, are disclosed. The improvements include a new heel filler for the heel portion of the sole, the filler being formed of a light-weight moulded plastic material. The heel filler may be easily located in the heel area prior to the final boot forming step. When a shank or protective mid-sole is to be used the appropriate element is provided with a slot or other locating device which may be secured to a cooperating projection on the heel filler so that the two components may be positively located together prior to the final boot forming step. The boot is strengthened by providing a longitudinally extending rib or ribs in the arch region of the shank or mid-sole. The boot is less expensive to produce because there is less possible wear or damage in the production equipment. In addition there are fewer production rejects and the resulting boot is stronger than prior art boots.

20 Claims, 12 Drawing Figures

HEEL FILLER AND ASSEMBLY FOR BOOTS

The present invention relates in general to the footwear industry and in particular to improvements in work shoes and boots and the protection afforded thereby to a wearer thereof.

BACKGROUND OF THE INVENTION

Protective footwear, such as work boots and shoes, has been manufactured for many years. Such footwear usually has a protective steel toe cap and may be provided with either a spring steel arch support or shank and/or a stainless steel protective mid-sole which protects the arch, ball and toe regions of the foot from nails or other sharp objects which might penetrate the sole of the boot. In order to save sole material, which is relatively expensive, such footwear usually has a heel plug or filler which is positioned in the heel and reduces the amount of sole material in the heel portion.

Some problems associated with the manufacture of work footwear, as detailed hereinafter, relate to the material and composition of the heel plug, the strength of the shank and/or mid-sole, and the location of these parts in the sole area during boot production.

With respect to the heel plug the material thereof has in the past been a laminated paperboard or fiberboard material and the plugs have been die cut from large sheets of the laminated material. Due to lateral compression of the material during die cutting the composition tends to flake. The resulting flakes can migrate to the outer surfaces of the heel and arch area during production and can then require additional repair steps to remove blemishes caused thereby.

Shanks, usually produced from heat treated spring steel, are used to strengthen the arch area and thus must be accurately located to serve their intended purpose. Once the sole has set it is difficult, if not impossible, to detect any dislocation of a shank. Such dislocation results in factory rejects or wearer discomfort if not detected at the factory. One of many past attempts at rectifying this problem involved the clinching of the shank to the bottom of the insole. This results in damage to the metal last on which the footwear upper is attached.

Protective mid-soles are not without their problems as well. They are difficult to properly locate during production; they do not always provide complete coverage to the sole area of the boot; and they may not provide sufficient rigidity to a boot if a shank is not used in conjunction therewith. Some attempts have been made to use a steel shank in combination with the stainless steel mid-sole but, unless a layer of an appropriate material is placed between these metal components, unacceptable "squeaking" due to the components rubbing together can result. Furthermore, since the shank is harder than the mid-sole, repeated flexing of the sole during use can cause the shank to wear through the mid-sole and perhaps then through the sole of the boot or shoe.

It is important to realize that safety footwear is relatively expensive, resulting from the cost of the special components used therein and the care needed in manufacture. High standards must be maintained to provide the wearer with maximum comfort and protection. Experience has shown that a person wearing protective footwear tends to become careless as to where he places his foot while working as he relies on his footwear to protect him. If the footwear does not provide maximum protection the wearer is operating with a false sense of security.

SUMMARY OF THE INVENTION

The present invention overcomes the various problems outlined above. The invention contemplates first of all the use of a moulded heel filler to replace the prior art laminated heel plug. The heel filler of this invention is advantageously provided with location means in the form of projections on the bottom surface or through holes to locate and anchor the heel filler during the sole production step. Also the heel filler is provided with means, such as an upwardly projecting rib, which can receive a slotted end of a shank or protective mid-sole so as to properly locate the shank or mid-sole in the boot sole relative to the heel filler.

The shank is usually provided with a central longitudinally extending rib or ribs which further strengthen the heat treated spring steel. Additionally the shank at one end is provided with the aforementioned slot or other cooperating locating mechanism for attachment to the heel filler.

Prior art mid-soles have varied in overall configuration from units barely covering the sole area to units covering the overall sole and heel area. This latter configuration is a waste of expensive material since no additional protection is really achieved when the heel area is covered. The most important areas to be protected are the arch and ball areas, with the arch area being the most vulnerable to penetration.

The protective mid-sole used in the present invention is standardized in overall configurations and extends rearwardly so as to overlie the forward portion of the heel filler, thereby bringing the slot therein into registry with the locating rib or projection on the heel filler. The mid-sole, like the shank, has a central rib extending longitudinally in the arch area to reduce the flexibility of the boot in this region. The central rib projects downwardly so that a nail or other sharp object penetrating the sole of the boot or shoe will be deflected to one side by the rib, thereby greatly reducing the chance of forced penetration of the mid-sole. With such a ribbed mid-sole there is no longer the necessity of providing a separate shank as in the past when additional arch support was desired.

By utilizing the various components of the present invention better work footwear is produced. With the heel filler there will be a much smaller percentage of production rejects and there will be less possible wear on production equipment. The unit cost of a boot or shoe will be less due to a reduction in cost of the heel filler over the prior art and due to a reduction in sole material since the present heel filler can be larger than the prior art heel plug. By using the heel filler in conjunction with a shank or protective mid-sole connected thereto there will be fewer problems in locating these elements in the sole during production. Furthermore the accurately located ribbed shank or mid-sole provides greater strength to the footwear and the standardized length and coverage of the mid-sole provides greater protection to the boot or shoe wearer.

In summary thereof the present invention broadly provides a heel filler for location in the heel portion of a boot or shoe, the heel filler comprising a block of moulded plastics material having a top surface, a bottom surface, side walls, a forward wall and a rearward wall.

The invention furthermore provides a heel filler for location in the heel portion of a boot or shoe, the heel filler comprising a block of moulded plastics material and having a top surface, a bottom surface, side walls, a forward wall and a rearward wall, the heel filler having shank or protective mid-sole locating means on the top surface and being provided with fixing means for positively fixing the block in the material of the heel portion.

In another embodiment the invention comprises a heel filler for location in the heel portion of a boot or shoe, the heel filler comprising a block of moulded plastics material having a top surface, a bottom surface, side walls, a forward wall and a rearward wall and having shank or protective mid-sole locating means on the top surface.

In yet another embodiment the invention contemplates a heel filler for location in the heel portion of a boot or shoe, the heel filler comprising a block of moulded plastics material having a top surface, a bottom surface, side walls, a forward wall and a rearward wall and having fixing means for positively fixing the block in the material of the heel portion.

Additionally, in another aspect the invention contemplates in combination a heel filler and shank assembly for location in the heel and arch portions respectively of a boot or shoe, the heel filler comprising a block of moulded plastics material having a top surface, a bottom surface, side walls, a forward wall and a rearward wall and shank locating means on the top surface, and the shank including an elongated member having cooperating means at one end thereof for attachment to the locating means.

In yet another aspect the invention contemplates in combination a heel filler and protective mid-sole for location in the heel and sole portions respectively of a boot or shoe, the heel filler comprising a block of moulded plastics material having a top surface, a bottom surface, side walls, a forward wall and a rearward wall and mid-sole locating means on the top surface, and the mid-sole including a generally smooth plate conforming to the shape of the sole, having cooperating means in the heel area thereof for attachment to the locating means.

DESCRIPTION OF THE PREFERRED EMBODIMENT

Figure 1:
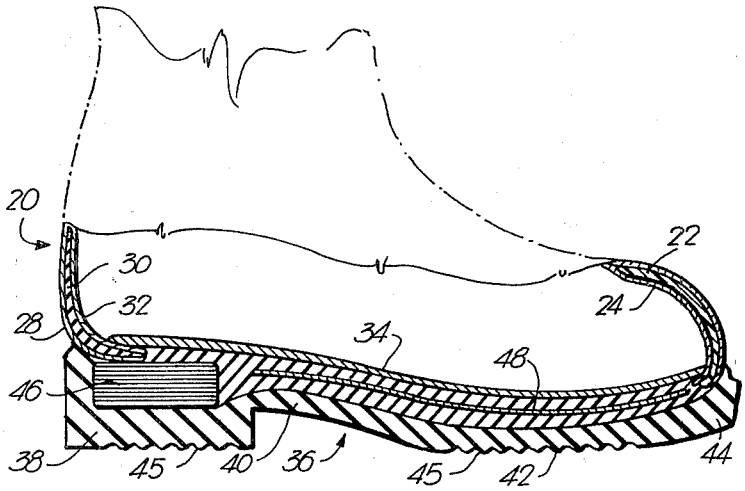
Fig. 1. (Prior Art)
FIG. 1 shows the sole portion of a prior art work boot in cross-section.
Figure 2:
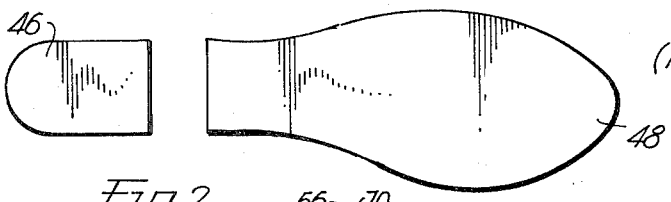
Fig. 2. (Prior Art)
FIG. 2 shows a plan view of a prior art heel plug and protective mid-sole.

FIG. 1 illustrates in cross-section the sole portion of a common work boot, the boot being designated by reference number 20. The illustrated boot is but one example of the many configurations offered on the market today and is intended only to show how some manufacturers presently attempt to provide reasonable protection for a wearer. The boot includes a protective high carbon steel toe cap 22 covered interiorly and exteriorly by leather layers 24 and 26 respectively. At the heel and ankle area, various layers of leather, constituting portions of the outer boot 28, the inner boot 30 and the heel reinforcement 32 are shown in part. The inner sole 34 is constructed of reconstituted leather.

The external sole 36 includes a heel portion 38, an arch portion 40, a ball portion 42 and a toe portion 44. The heel and ball portions have corrugations 45 or other friction-enhancing means on the underside thereof.

As seen in FIG. 1 the sole 36 is provided internally with a heel plug 46 and a protective sole piece 48. The heel plug 46 in the past has been formed as a compressed laminate of paperboard material such as is sold under the trademark "Homosote". Such material is provided as a large sheet and the plugs are die cut therefrom. The die cutting operation is not completely clean, however, as discussed hereinabove, and the paperboard material tends to flake or leave bits of "dust" clinging thereto which can be detrimental to subsequent processes. The protective sole piece 48 is typically formed of type 301 stainless steel and conforms generally to the outline of the outer sole in the arch, ball and toe regions. The protective sole piece 48 is intended to protect the foot of the boot wearer from nails or other sharp objects which might penetrate the sole 36 in the arch, ball or toe regions. The heel plug affords some protection but its primary purpose is to fill in a portion of the heel 38 so that the amount of material used to mould the sole, in the heel region, can be reduced. Such material is very expensive.

There are essentially two processes by which the soles of work boots are secured to the leather uppers. In the first process a gummy rubbery material is placed in a mould which conforms to the outline of the outer sole 36 and which also defines the outer configuration, including corrugations, etc. After the rubbery material has partially cured, the heel plug 46 and the protective sole piece 48 are placed, by hand, on the material already in the mould, additional material is added and the upper including the inner sole 34 is brought into contact with the rubbery material by way of a last. The rubbery material is then vulcanized under high heat and pressure to completely set the material, secure the upper to the sole, and in essence encapsulate the heel plug 46 and the protective sole piece 48 in the sole 36.

The second method involves an injection moulding process with requires prelocation of the upper, heel plug and protective sole piece prior to the moulding step.

In both of the above described methods there is little absolute control over the final position and orientation of the heel plug and/or the protective sole piece. These items have been known to drift from their set positions to their final positions as much as one-half inch. This of course is very detrimental and can result in failures and/or factory rejects. Also, the aforementioned problem with the die cut laminated paperboard heel plugs is manifested at the moulding stages as the flakes tend to migrate to the outer surface of the heel or arch areas of the sole. When this happens the flakes must be ground away from the sole surface and a filler compound smoothed over the ground area to improve the appearance of the sole.

Some of the flaking problems have been overcome by using a laminated fiberboard material for the heel plug but such material substitution has resulted in higher costs of production as the fiberboard material is more expensive than the older paperboard material.

Figure 3:
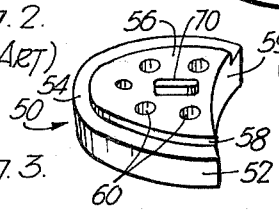
FIG. 3 shows a perspective view of the heel filler of the present invention.

The present invention overcomes the various problems of the prior art and is illustrated in the drawings starting with FIG. 3. That figure shows a one-piece moulded heel filler 50 which is larger in all dimensions than the prior art heel plugs 46, which is lighter in weight and is less expensive to produce. The heel filler 50 is advantageously moulded by conventional means of a blown or expanded polyethylene material. Other plastics including both thermosets and thermoplastics may be used. In addition to the advantages outlined above, the configuration of the heel filler 50 provides additional advantages not available with the prior art.

With reference to FIG. 3 the heel filler 50 has a peripheral side surface 52 which corresponds generally in transverse cross-section to the cross-section of the heel 38 in which it will reside. The transverse cross-sectional dimensions of the heel filler 50 are greater than those of the prior art heel plug 46 which it replaces and this will result in a saving in the rubbery material constituting the heel portion 38 of the boot sole.

Furthermore the upper surface of the heel filler 50 is formed as a step whereby there is a first upper surface 54 which is adjacent the side and rear side walls of the heel filler. A raised portion 56 rises above the surface 54 and is defined by side wall 58. The surface 54 provides a convenient locating and receiving surface for the lowermost ends of the portions 28, 30 and 32 of the upper during the lasting or moulding step when the upper is secured to the sole.

Figure 6:
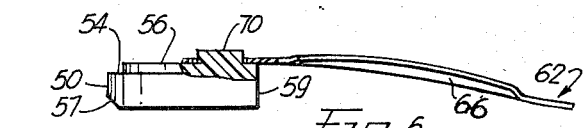
FIGS. 6 and 7 show the heel filler of the present invention assembled to a shank and a protective sole respectively.
Figure 7:
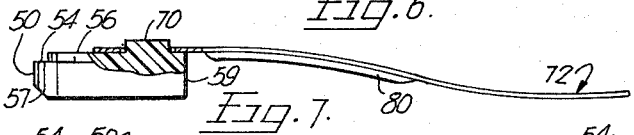

As shown in FIGS. 6 and 7 the rear bottom portion of the heel filler may be bevelled as at 57 so that more sole material is provided in the bottom rear area of the heel, which area is most prone to wear during walking. The forward wall 59 of the heel filler may be curved as shown in FIG. 3, flat as shown in FIGS. 8 to 11, or of any other desired shape.

The heel filler 50 may be advantageously provided, if desired, with through holes 60 which extend from the top surface of the raised portion through to the bottom surface of the heel filler. When the sole is finally formed, whether through vulcanizing or injection moulding, the material of the sole can flow into the bores 60 to help locate and rigidify the heel filler 50 in position. Additionally the bores 60 themselves aid in rigifying the heel filler. Since the heel filler is desirably formed in a blow moulding or expansion process the interior of the heel filler will be somewhat porous. However, at any surface a "skin" of the material will form, which "skin" increases the resistance of the moulded articles to compressive failure. The through bores 60 will increase the amount of "skin" as a "skin" will form thereabout and thus the resistance to failure of a heel filler having such bores will be greater than that of a heel filler not so provided.

The heel filler of the present invention as described hereinabove will have greater utility than, and is an improvement over, prior art heel plugs and can be used, as described, as a direct replacement for such heel plugs in any shoe or boot which can make use of such a filler or plug.

The greatest advantage can be achieved, however, if the heel filler of the present invention is used in conjunction with other elements to be described hereinbelow in the manufacture of work boots.

Some boots, as discussed above, use a protective mid-sole 48 to protect the arch, ball and toe areas of the foot. Other boots may use a narrow arch support or shank which is positioned on the longitudinal axis of the boot and is embedded in the sole over the arch portion. Such shanks have typically been formed from heat treated spring steel and may have dimensions of, say 2 by 12 cm. Such shanks are stamped and formed to conform generally to the shape of the arch portion of the boot. However, even though formed of a strong resilient material such prior art shanks have been known to take an unwanted set when the boot wearer, for example, has placed all of his weight on one foot on the narrow rung of a ladder. Furthermore it is very difficult to locate the shank in the sole during production as the locating step must be done by hand.

Figure 5:
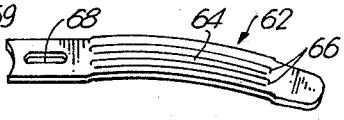
FIG. 5 shows a perspective view of a shank for use with the heel filler of the present invention.

The shank described hereinbelow overcomes both of these problems. First of all as shown in FIG. 5 the shank 62 is formed so as to have a central, longitudinally extending rib 64 which projects upwardly and a pair of parallel downwardly projecting ribs 66 on each side thereof. The ribs 64, 66 greatly increase the resistance of the shank to taking a set in view of excessive vertically oriented forces imposed thereon. Additionally the shank 62 is provided with a relatively short, central, longitudinally extending through slot 68. This slot fits over, in a close interference fit therewith, an elongated projection 70 formed on the top surface of the heel filler 50 as shown in FIG. 6. With the shank connected to the heel filler in this manner the assembly operator only has to concern himself with properly locating a single element (made up of two parts) in the mould or rubbery material, rather than with two separate parts. Even though a pre-assembly step is required with the present invention the overall saving in time and rejected or spoiled units greatly outweighs the cost of the pre-assembly step.

Figure 4:
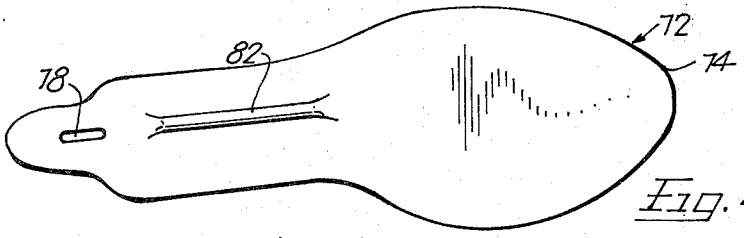
FIG. 4 shows a perspective view of a protective sole for use with the heel filler of the present invention.

In work boots which use a protective mid-sole such as 48, advantages can be achieved with an improved mid-sole 72 illustrated in FIGS. 4 and 7, especially when the mid-sole 72 is used in conjunction with the previously described heel filler 50. As seen in plan view in FIG. 4 the mid-sole 72 has a periphery which, like that of mid-sole 48, conforms to the outline of the sole portions 40, 42 and 44 and is shaped as required to conform to the shape of the sole in vertical cross-section as shown in FIG. 1. However, mid-sole 72 is longer than mid-sole 48, having a rear portion which extends rearwardly a sufficient distance to overlie the forward portion of the heel filler 50. This rear portion is provided with a longitudinally extending slot 78 which, like slot 68 in shank 62, can fit on the projection 70 provided on the top surface of the heel filler 50. The same advantages in assembly accrue to the combination of the heel filler 50 and mid-sole 72 as accrue to the combination of the heel filler 50 and the shank 62. Additionally the mid-sole 72 is advantageously provided with a central longitudinally extending and downwardly projecting rib 80 (FIG. 7) which strengthens the mid-sole 72 in the arch region and eliminates the necessity of a separate arch support or shank, such as shank 62, in boots provided with a protective mid-sole. On the upper surface of the mid-sole 72 the rib 80 appears as a groove 82. By having the rib 80 face downwardly the rib 80 will deflect the point of a nail, or other sharp object, away from an orientation which might otherwise cause penetration of the mid-sole. If the rib 80 were to face upwardly the resulting groove in the underside of the mid-sole 72 would actually guide the sharp object more into a detrimental penetrating orientation.

Figure 8:
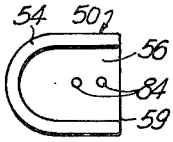
Figure 9:
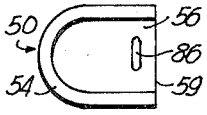
Figure 10:
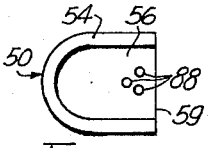

Turning now to FIGS. 8 through 12, various other configurations for the heel filler 50 are illustrated. In FIG. 8 the projection 70 is replaced by a pair of upstanding transversely spaced circular projections 84. In FIG. 9 a transverse rib or projection 86 replaces the longitudinal projection 70 and in FIG. 10 three circular projections 88 are utilized. With each of these configurations it is understood that the shank 62 or mid-sole 72 will be provided with corresponding holes or slots to mate with the particular projection configuration provided on the heel filler 50.

Figure 12:
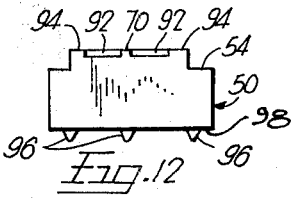
FIGS. 8 to 12 show various alternative securing configurations for the heel filler of the present invention.
Figure 11:
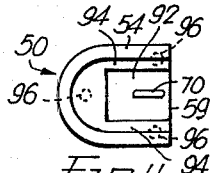

FIGS. 11 and 12 illustrate an embodiment of the heel filler which is particularly advantageous with a shank 62. In this case the upper raised portion 56 is provided with a recess 90, the bottom surface 92 of which is coplanar with the surface 54. The projection 70, as illustrated, rises from the surface 92 and cooperates with the corresponding slot 68 in the shank. Ribs 94 define the recess, separating it from the outer portion of the heel filler top.

FIGS. 11 and 12 also show three downwardly extending conical projections 96 depending from the bottom surface 98 of the heel filler 50. These projections can aid in positively locating the heel filler in the rubbery material of the sole prior to the vulcanization step. Such projections may be provided on any of the other configurations for the heel filler as shown in FIGS. 3 and 8 to 10.

It should also be mentioned that during the vulcanization or injection moulding step when the upper is attached to the sole, the heat used in that step and the pressure applied by the last will tend to melt that portion of the locating projection 70 or 84, 86, 88 which initially rises above the shank 62 or mid-sole 72 so as to positively secure the two parts together as in a rivetting or staking operation.

Notwithstanding the aforementioned location and assembly advantages of this invention over the prior art and without altering the concept, an alternative method of pre-assembly is possible. The heel filler, as previously described but absent the protruding locating means on the top surface thereof, can be pre-assembled with either a shank or protective mid-sole by means of insert-moulding at the time the heel filler itself is moulded from plastics material. This generally involves positioning the shank or mid-sole by mechanical or other means in the mould prior to injection moulding the heel filler. This process, carried out by the component manufacturer, is commonly described as "insert moulding". The final assembly, either shank or mid-sole with a heel filler, is integral and functions in exactly the same way as an assembly of separate components as described hereinabove.

Another variation in the aforementioned invention which results in an improved product involves coating the stainless steel mid-sole with an adhesive material such as is available under the trademark CHEMLOK 250 available from Hughson Chemicals. This material is vulcanizable and will securely bond the mid-sole to the sole material during a vulcanizing boot-forming step. A mid-sole bonded in this manner will not shift at all in its position. It is also conceivable that the mid-sole could be formed to advantage from materials other than stainless steel, one such possibility being KEVLAR (trade mark of E. I. du Pont de Nemours and Company).

The preferred embodiments of the present inventior have been described hereinabove. It is understood tha other variations from the described embodiments coulc occur to a person skilled in the art without departing from the spirit of the present invention. Hence the protection to be afforded the present invention should be determined from the claims appended hereto in conjunction with the foregoing disclosure.

The embodiments of the invention in which an exclusive property or privilege is claimed are defined as follows:

1. A heel filler for location in the heel portion of a boot or shoe, said heel filler comprising a block of molded plastics material and having a top surface, a bottom surface, side walls, a forward wall and a rearward wall, said heel filler having a shank or protective mid-sole locating member in the form of an elongated, longitudinally extending rib projecting upwardly from said top surface and being provided with fixing means for positively fixing said block in the material of said heel portion.

2. A heel filler for location in the heel portion of a boot or shoe, said heel filler comprising a block of molded plastics material and having a top surface, a bottom surface, side walls, a forward wall and a rearward wall, said heel filler having a shank or protective mid-sole locating member in the form of an elongated, transversely extending rib projecting upwardly from said top surface and being provided with fixing means for positively fixing said block in the material of said heel portion.

3. A heel filler for location in the heel portion of a boot or shoe, said heel filler comprising a block of molded plastics material and having a top surface, a bottom surface, side walls, a forward wall and a rearward wall, said heel filler having a shank or protective mid-sole locating member in the form of a plurality of circular projections projecting upwardly from said top surface and being provided with fixing means for positively fixing said block in the material of said heel portion.

4. The heel filler of claim 1 including a recess in said top surface opening towards said front wall for receiving one end of a shank therein, said elongated, longitudinally extending rib projecting upwardly within said recess.

5. The heel filler of claim 1 and including a shoulder portion at a level below said top surface and extending along said side and rearward walls.

6. The heel filler of claim 4 and including a shoulder portion at a level below said top surface and extending along said side and rearward walls, said shoulder portion being coplanar with the bottom surface of said recess and being separated from said recess by longitudinally extending ribs running parallel to said side walls.

7. The heel filler of claim 1 wherein said fixing means includes a plurality of bores extending through said block from said top surface to said bottom surface.

8. The heel filler of claim 1 wherein said fixing means includes a plurality of conical projections extending downwardly from said bottom surface.

9. A heel filler for location in the heel portion of a boot or shoe, said heel filler comprising a block of molded plastics material having a top surface, a bottom surface, side walls, a forward wall and a rearward wall and having a shank or protective mid-sole locating member in the form of an elongated rib projecting upwardly from said top surface.

10. In combination a heel filler and shank assembly for location in the heel and arch portions respectively of a boot or shoe, said heel filler comprising a block of moulded plastics material having a top surface, a bottom surface, side walls, a forward wall and a rearward wall and a shank locating member projecting upwardly from said top surface, and said shank including an elongated member having opening means therethrough at one end thereof for attachment to said locating means.

11. The combination of claim 10 wherein said shank is provided with generally central, longitudinally extending and downwardly directed reinforcing rib means therein.

12. The combination of claim 10 or 11 wherein said locating member comprises an elongated, longitudinally extending rib and said opening means includes an elongated, longitudinally extending slot in said one end of said shank.

13. The combination of claim 10 or 11 wherein said locating member comprises an elongated, transversely extending rib and said opening means includes an elongated transversely extending slot in said one end of said shank.

14. The combination of claim 10 or 11 wherein said locating member comprises a plurality of circular projections and said opening means includes a plurality of circular holes in said one end of said shank.

15. The combination of claim 10 or 11 including a recess in said top surface opening towards said front wall for receiving said one end of said shank therein, and wherein said locating member comprises an elongated, longitudinally extending rib centrally positioned within said recess, said opening means including a central, longitudinally extending slot in said one end of said shank.

16. In combination a heel filler and protective mid-sole for location in the heel and sole portions respectively of a boot or shoe, said heel filler comprising a block of moulded plastics material having a top surface, a bottom surface, side walls, a forward wall and a rearward wall and mid-sole locating member projecting upwardly from said top surface, and said mid-sole including a generally smooth plate conforming to the shape of said sole, having opening means in the heel area thereof for cooperating attachment to said locating member.

17. The combination of claim 16 wherein said mid-sole is provided with generally central, longitudinally extending and downwardly directed reinforcing rib means in the arch area thereof.

18. The combination of claim 16 or 17 wherein said locating member comprises an elongated, longitudinally extending rib and said opening means includes an elongated, longitudinally extending slot in said one end of said mid-sole.

19. The combination of claim 16 or 17 wherein said locating member comprises an elongated, transversely extending rib and said opening means includes an elongated, transversely extending slot in said one end of said mid-sole.

20. The combination of claim 16 or 17 wherein said locating member comprises a plurality of circular projections and said opening means includes a plurality of circular holes in said one end of said mid-sole.

* * * * *